US010662957B2

(12) United States Patent
Nonaka et al.

(10) Patent No.: US 10,662,957 B2
(45) Date of Patent: May 26, 2020

(54) VACUUM EXHAUST MECHANISM, COMPOUND TYPE VACUUM PUMP, AND ROTATING BODY PART

(71) Applicant: Edwards Japan Limited, Yachiyo-shi, Chiba (JP)

(72) Inventors: Manabu Nonaka, Yachiyo (JP); Takashi Kabasawa, Yachiyo (JP)

(73) Assignee: Edwards Japan Limited, Chiba (JP)

( * ) Notice: Subject to any disclaimer, the term of this patent is extended or adjusted under 35 U.S.C. 154(b) by 765 days.

(21) Appl. No.: 15/105,368

(22) PCT Filed: Oct. 29, 2014

(86) PCT No.: PCT/JP2014/078688
§ 371 (c)(1),
(2) Date: Jun. 16, 2016

(87) PCT Pub. No.: WO2015/098275
PCT Pub. Date: Jul. 2, 2015

(65) Prior Publication Data

US 2016/0319825 A1 Nov. 3, 2016

(30) Foreign Application Priority Data

Dec. 26, 2013 (JP) ..... 2013-268615

(51) Int. Cl.
*F04D 25/16* (2006.01)
*F04D 19/04* (2006.01)
(Continued)

(52) U.S. Cl.
CPC ..... *F04D 25/16* (2013.01); *F04D 17/168* (2013.01); *F04D 19/042* (2013.01);
(Continued)

(58) Field of Classification Search
CPC ..... F04D 25/16; F04D 17/168; F04D 19/042; F04D 19/046; F04D 29/053; F04D 29/28; F04D 29/384; F04D 29/4206
See application file for complete search history.

(56) References Cited

U.S. PATENT DOCUMENTS 4,655,678 A * 4/1987 Miki ..... F04D 17/168 415/71
5,358,373 A * 10/1994 Hablanian ..... F04D 17/168 415/194
(Continued)

FOREIGN PATENT DOCUMENTS

CN 1039287 A 1/1990
CN 1110376 A 10/1995
(Continued)

OTHER PUBLICATIONS

PCT International Search Report dated Feb. 3, 2015 for corresponding PCT Application No. PCT/JP2014/078688.
(Continued)

*Primary Examiner* — Richard A Edgar
*Assistant Examiner* — Joshua R Beebe
(74) *Attorney, Agent, or Firm* — Westman, Champlin & Koehler, P.A.; Theodore M. Magee

(57) ABSTRACT

A vacuum pump has, in at least either a stator disc to be disposed or a rotating disc to be disposed, a Siegbahn type molecular pump portion in which a spiral-shaped groove with a ridge portion and a root portion is engraved (disposed), and is structured to ensure high conductance at a returning flow channel formed at the outer periphery (outside) of the Siegbahn type molecular pump portion. This structure is created by a communicating portion (a groove portion, a slit) formed on each rotating disc, or an oblique plate disposed on the stator disc and the communicating portion formed on the rotating disc. The "communicating
(Continued)

portion," "groove portion," and "slit" are configured to have "concave" shapes, a concave portion is provided by engraving a groove radially inward from an outer diameter portion (toward a side of a shaft of the vacuum pump) in the rotating disc (or stator disc).

10 Claims, 8 Drawing Sheets

(51) Int. Cl.

| | |
|---|---|
| ***F04D 17/16*** | (2006.01) |
| ***F04D 29/053*** | (2006.01) |
| ***F04D 29/28*** | (2006.01) |
| ***F04D 29/38*** | (2006.01) |
| ***F04D 29/42*** | (2006.01) |

(52) U.S. Cl.
CPC ..... *F04D 19/046* (2013.01); *F04D 29/053* (2013.01); *F04D 29/28* (2013.01); *F04D 29/384* (2013.01); *F04D 29/4206* (2013.01)

(56) References Cited

U.S. PATENT DOCUMENTS

| | | | | |
|---|---|---|---|---|
| 6,343,910 | B1 * | 2/2002 | Kawasaki | F04D 19/046 415/90 |
| 6,409,468 | B1 * | 6/2002 | Kawasaki | F04D 17/168 415/199.3 |
| 9,309,892 | B2 * | 4/2016 | Tollner | F04D 19/042 |
| 2009/0246038 | A1 | 10/2009 | Kawasaki et al. | |
| 2010/0158672 | A1 * | 6/2010 | Helmer | F04D 17/168 415/120 |
| 2012/0201696 | A1 * | 8/2012 | Tollner | F04D 19/042 417/199.1 |

FOREIGN PATENT DOCUMENTS

| | | | |
|---|---|---|---|
| CN | 101457758 | A | 6/2009 |
| CN | 101709713 | A | 5/2010 |
| CN | 103104512 | A | 5/2013 |
| DE | 3922782 | A1 | 2/1990 |
| EP | 1508700 | A2 | 2/2005 |
| EP | 1724469 | A2 | 11/2006 |
| EP | 2730782 | A2 | 5/2014 |
| EP | 3076021 | A1 | 5/2016 |
| JP | S60204997 | | 10/1985 |
| JP | S61226596 | A | 10/1986 |
| JP | H0220798 | | 2/1990 |
| JP | 2009047178 | A | 3/2009 |
| JP | 2009203906 | A | 9/2009 |
| JP | 2009235922 | A | 10/2009 |

OTHER PUBLICATIONS

PCT International Written Opinion dated Feb. 3, 2015 for corresponding PCT Application No. PCT/JP2014/078688.
Japanese Utility Model Application No. 42995/1990 (Laid-Open No. 6591/1992)(Mitsubishi Heavy Industries, Ltd.), Jan. 21, 1992.
Supplementary European Search Report dated Oct. 19, 2017 and Communication dated Nov. 2, 2017 for corresponding European Application No. 14874362.8.

* cited by examiner

VACUUM EXHAUST MECHANISM, COMPOUND TYPE VACUUM PUMP, AND ROTATING BODY PART

CROSS-REFERENCE TO RELATED APPLICATION

This Application is a Section 371 National Stage Application of International Application No. PCT/JP2014/078688, filed Oct. 29, 2014, which is incorporated by reference in its entirety and published as WO 2015/098275 on Jul. 2, 2015 and which claims priority of Japanese Application No. 2013-268615, filed Dec. 26, 2013.

BACKGROUND OF THE INVENTION

1. Field of the Invention

The present invention relates to a vacuum exhaust mechanism, a compound type vacuum pump, and a rotating body part. More specifically, the present invention relates to a vacuum exhaust mechanism, a compound type vacuum pump, and a rotatoring body part that are capable of effectively connecting pipe lines having exhaust actions in a vacuum pump to be disposed.

2. Description of the Related Art

The vacuum pump according to the present invention has a casing that configures a housing having an inlet port and an outlet port, in which a structure that brings out the exhaust function of the vacuum pump is stored in this casing. This structure bringing out the exhaust function is configured mainly with a rotating portion (rotor portion) that is axially supported rotatably and a stator portion fixed to the casing.

The vacuum pump is also provided with a motor for rotating a rotating shaft at high speeds. By causing the motor to rotate the rotating shaft at high speed, gas is suctioned through the inlet port and discharged through the outlet port by the interaction between rotor blades (rotating discs) and stator blades (stator discs).

Of vacuum pumps, a Siegbahn type molecular pump with a Siegbahn type configuration has rotating discs (rotating circular plates) and stator discs arranged with a gap (clearance) with the rotating discs in an axial direction, wherein a spiral-shaped groove (helical groove or coil-shaped groove) flow channel is formed on the surface of at least each rotating disc or stator disc that is opposite to the gap. In this vacuum pump, the gas molecules spreading inside the spiral-shaped groove flow channel are given a momentum in a rotating disc tangential direction (i.e., the direction of the tangent to the direction of rotation of the rotating discs) by the rotating discs, and thereby evacuated with advantageous directivity through the spiral-shaped grooves from the inlet port toward the outlet port.

In order to industrially apply such Siegbahn type molecular pump or a vacuum pump having a Siegbahn type molecular pump portion, the rotating discs and the stator disc are arranged in multiple stages because with single stages of a rotating disc and a stator disc the compression ratio becomes insufficient.

The Siegbahn type molecular pump is a radial flow pump element. Therefore, in order to arrange the discs in multiple stages, a configuration is necessary in which, for example, the gas turns at the outer peripheral end portions and the inner peripheral end portions of the rotating discs and stator disc so as to be evacuated from the inlet port to the outlet port (i.e., along the axial direction of the vacuum pump), such as from the outer peripheral portion to the inner peripheral portion, then from the inner peripheral portion to the outer peripheral portion, and then again from the outer peripheral portion to the inner peripheral portion.

Japanese Patent Application Laid-open No. S60-204997 discloses a vacuum pump that has, in a pump housing, a turbomolecular pump portion, a spiral-shaped groove pump portion, and a centrifugal pump portion.

Japanese Utility Model Registration No. 2501275 discloses a Siegbahn type molecular pump in which spiral-shaped grooves extending in different directions are provided on a surface of each rotating disc and a surface of each stationary disc that are opposed each other.

The flow of gas molecules (gas) in the configuration described in each of these conventional technologies is as follows.

The gas molecules that are transferred to the inner diameter portion of an upstream Siegbahn type molecular pump portion are discharged to a space formed between a rotating cylinder and a stator disc. The gas molecules are then suctioned into the inner diameter portion of a downstream Siegbahn type molecular pump portion that is opened to the space, and then transferred to the outer diameter portion of the downstream Siegbahn type molecular pump portion. In a case where the discs are arranged in multiple stages, this flow of gas repeats throughout the stages.

However, since the exhaust does not act in the space described above (i.e., the space formed between the rotating cylinder and each stator disc), the momentum in the exhaust direction that is given to the gas molecules in the upstream Siegbahn type molecular pump portion is lost as soon as the gas molecules reach this space.

The discussion above is merely provided for general background information and is not intended to be used as an aid in determining the scope of the claimed subject matter. The claimed subject matter is not limited to implementations that solve any or all disadvantages noted in the background.

SUMMARY OF THE INVENTION

FIG. 7 is a diagram for explaining a conventional Siegbahn type molecular pump 1000, showing an example of a schematic configuration of the conventional Siegbahn type molecular pump 1000. The arrows show how the gas molecules flow.

Hereinafter, the inlet port 4 side of a single (single-stage) stator disc 5000 is described as a Siegbahn type molecular pump upstream region, and the outlet port 6 side of the same is described as Siegbahn type molecular pump downstream region.

FIG. 8 is a diagram for explaining the stator disc 5000 disposed in the conventional Siegbahn type molecular pump 1000, showing a cross-sectional diagram of the stator disc 5000 viewed from the inlet port 4 (FIG. 7) of the conventional Siegbahn type molecular pump 1000. The arrows inside the stator disc 5000 show how the gas molecules flow, and the arrow outside the stator disc 5000 represents the direction of rotation of rotating discs 9000 (FIG. 7).

As described above, even if an advantageous momentum is given to the gas molecules aiming at the outlet port 6 in the Siegbahn type molecular pump 1000, the given momentum is lost because an outer returning flow channel b for the gas molecules is merely a "connecting" space that does not have an exhaust. Consequently, the exhaust breaks off in the outer returning flow channel b, releasing the gas molecules each time passing through the outer turn-back flow channel b. As a result, favorable exhaust efficiency cannot be realized by this conventional Siegbahn type molecular pump 1000.

Reducing the cross-sectional area of the outer returning flow channel b (i.e., narrowing the gap formed between the outer diameter portion of the rotating disc 9000 and the inner diameter of a spacer 60) leads to accumulation of the gas molecules in the outer returning flow channel b and an increase in the pressure in the outer returning flow channel b which is the outlet of the Siegbahn type molecular pump downstream region (the returning portion from the downstream region of an upper stator disc 5000 toward the upstream region of a lower stator disc 5000). As a result, pressure loss occurs, lowering the exhaust efficiency of the entire vacuum pump (the Siegbahn type molecular pump 1000).

For the purpose of preventing such decrease of the exhaust efficiency, in the past the cross-sectional area and pipe line width of the outer returning flow channel b had to be significantly greater than the cross-sectional area and width of a pipe line of the Siegbahn type molecular pump (a tubular flow channel that is a pipe line and gap formed between a part of the rotating disc 9000 and a part of the stator disc 5000 that are opposite to each other (in the axial direction), through which the gas molecules pass).

However, increasing the size of the outer returning flow channel b leads to an increase in the diameters of a casing 2 and the spacer 60, increasing the size of the pump and the material costs.

Moreover, in order to reduce the outer diameter of the rotating disc 9000 or the stator disc 5000 to ensure the cross-sectional area of the outer returning flow channel b, the length of the flow channel in the radial direction needs to be reduced, as well as the compression performance per stage. As a result, the number of stages in the Siegbahn type molecular pump portion needs to be increased.

However, increasing the number of stages leads to an increase in the material cost and machining costs of the rotating disc 9000 and stator disc 5000.

In addition, when the mass/inertia moment of the rotating disc 9000 increases due to high-speed rotation thereof, extra capacity of a magnetic bearing device supporting the rotating disc needs to be increased accordingly, resulting in an increase in the costs of components configuring the vacuum pump.

On the other hand, reducing the outer diameter of the stator disc 5000 on the outer diameter side to increase the size of the outer returning flow channel b, leads to a decrease in the radial size of the Siegbahn type molecular pump portion, and hence insufficient compression performance per stage.

An object of the present invention, therefore, is to provide a vacuum exhaust mechanism, a compound type vacuum pump, and a rotatoring body part that are capable of effectively connecting pipe lines having exhaust actions in a vacuum pump to be disposed.

In order to achieve the foregoing object, the invention described in claim 1 provides a vacuum exhaust mechanism, having: a housing in which an inlet port and an outlet port are formed; a rotary shaft contained in the housing and supported in a rotatably manner; a rotatoring body part that has a rotating disc-shaped portion disposed on the rotary shaft or an outer peripheral surface of a cylindrical body disposed around the rotary shaft; a stator disc-shaped portion that is disposed concentrically with the rotating disc-shaped portion and is opposite to the rotating disc-shaped portion in an axial direction with a space therebetween; and a spacer portion that is formed separately from the stator disc-shaped portion or integrally with the stator disc-shaped portion in order to fix the stator disc-shaped portion, the vacuum exhaust mechanism transferring a gas suctioned from a side of the inlet port to a side of the outlet port by an interaction between the rotating disc-shaped portion and the stator disc-shaped portion, a spiral-shaped groove with a ridge portion and a root portion is provided in at least a part of an opposed surface of at least either the rotating disc-shaped portion or the stator disc-shaped portion in the axial direction, and the rotating disc-shaped portion has, in at least a part of an outer peripheral portion thereof, a groove portion for connecting a surface of the rotating disc-shaped portion on the side of the inlet port with a surface of the same on the side of the outlet port.

The invention described in claim 2 provides the vacuum exhaust mechanism according to claim 1, wherein the groove portion is disposed to incline in an exhaust direction of the vacuum exhaust mechanism at an inclination angle to a central axis of the rotating disc-shaped portion.

The invention described in claim 3 provides vacuum exhaust mechanism according to claim 2, wherein an oblique plate which opposes to at least either an opening end of the groove portion on the side of the inlet port or an opening end of the same on the side of the outlet port is provided to at least either the stator disc-shaped portion or the spacer portion, and the oblique plate is disposed to incline in an direction opposite to the inclination angle of the groove portion at an inclination angle to the central axis of the rotating disc-shaped portion.

The invention described in claim 4 provides a compound type vacuum pump, including in a compounded form: a Siegbahn type exhaust mechanism portion having the vacuum exhaust mechanism of claim 1, 2 or 3; and a thread groove type molecular pump mechanism portion, which is a vacuum exhaust mechanism that has a thread groove in at least a part of an opposed surface, at which a stator portion disposed inside the housing and an outer peripheral surface of a cylindrical body disposed around the rotary shaft are opposite to each other, and transfers the gas suctioned from the side of the inlet port to the side of the outlet port.

The invention described in claim 5 provides a compound type vacuum pump, including in a compounded form: a Siegbahn type exhaust mechanism portion having the vacuum exhaust mechanism of claim 1, 2 or 3; rotor blades that extend radially from the rotary shaft or an outer peripheral surface of a cylindrical body disposed around the rotary shaft; and a turbomolecular pump mechanism portion, which is a vacuum exhaust mechanism that has stator blades disposed with a predetermined distance to the rotor blades and transfers the gas suctioned from the side of the inlet port to the side of the outlet port, by an interaction between the rotor blades and the stator blades.

The invention described in claim 6 provides a compound type vacuum pump, including in a compounded form: a Siegbahn type exhaust mechanism portion having the vacuum exhaust mechanism of claim 1, 2 or 3; a thread groove type pump mechanism portion that has a thread groove in at least a part of an opposed surface, at which a stator portion disposed inside the housing and an outer peripheral surface of a cylindrical body disposed around the rotary shaft are opposite to each other, and transfers the gas suctioned from the side of the inlet port to the side of the outlet port; and a turbomolecular pump mechanism portion, which is a vacuum exhaust mechanism that has rotor blades that extend radially from the rotary shaft or an outer peripheral surface of the cylindrical body disposed around the rotary shaft and stator blades disposed with a predetermined distance to the rotor blades, and transfers the gas suctioned from the side of the inlet port to the side of the outlet port, by an interaction between the rotor blades and the stator blades.

The invention provides a rotatoring body part according to any one of claims 1, 2 and 3, which has the rotary shaft and a rotating disc-shaped portion disposed around the rotary shaft, and is used in a vacuum pump, wherein the rotating disc-shaped portion has, in at least a part of an outer peripheral portion thereof, a groove portion for connecting a surface of the rotating disc-shaped portion on the side of inlet port of the vacuum pump with a surface of the same on the side of the outlet port of the vacuum pump.

The invention provides the rotatoring body, wherein the rotating disc-shaped portion has a spiral-shaped groove with a ridge portion and a root portion in at least a part of at least either a surface of the rotating disc-shaped portion on the side of inlet port of the vacuum pump or a surface of the same on the side of the outlet port of the vacuum pump.

The invention described in claim 9 provides the rotatoring body part according to claim 7 or 8, wherein the groove portion is disposed at a predetermined angle to a central axis of the rotating disc-shaped portion.

The invention described in claim 10 provides a rotatoring body part, which is used in a vacuum pump having an inlet port and an outlet port and which has a rotating disc-shaped portion, wherein at least a part of an opposed surface of at least either the rotating disc-shaped portion or a stator disc-shaped portion that is opposite to the rotating disc-shaped portion in an axial direction with a space therebetween, has a spiral-shaped groove with a ridge portion and a root portion in the axial direction, and the rotating disc-shaped portion has, in at least a part of an outer peripheral portion thereof, a groove portion for connecting a surface of the rotating disc-shaped portion on the side of the inlet port with a surface of the same on the side of the outlet port.

The present invention can provide a vacuum exhaust mechanism and a rotatoring body part that are capable of effectively connecting pipe lines having exhaust actions in a vacuum pump to be disposed, and a compound type vacuum pump capable of effectively connecting the pipe lines having exhaust actions.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DESCRIPTION OF THE PREFERRED EMBODIMENTS

(i) Summary of Embodiments

A vacuum pump according to an embodiment of the present invention has a Siegbahn type molecular pump portion in which a spiral-shaped groove with a ridge portion and a root portion is engraved (disposed) in at least each stator disc (stator disc-shaped portion) to be disposed or each rotating disc (rotating disc-shaped portion) to be disposed. The vacuum pump is structured to ensure high conductance at a returning flow channel formed at the outer periphery (outside) of the Siegbahn type molecular pump portion.

In the embodiment of the present invention, the structure for ensuring high conductance is created inside the vacuum pump by a communicating portion (a groove portion, a slit) formed on each rotating disc, or an oblique plate disposed on each stator disc and the communicating portion formed on each rotating disc.

In the embodiment of the present invention, such terms as "communicating portion," "groove portion," and "slit" are used to express a "concave" shape. This portion in a concave shape (concave portion) is a groove engraved in each rotating disc (or stator disc). Precisely, this concave portion is a groove engraved radially inward from the outer diameter portion (toward the part of the vacuum pump where the shaft is disposed) in each rotating disc (or stator disc). Hereinafter, the present embodiment generically describes this concave portion "groove portion."

(ii) Details of Embodiments

Preferred embodiments of the present invention are described hereinafter in detail with reference to FIGS. 1 to 6.

The present embodiment describes a Siegbahn type molecular pump as an example of a vacuum pump in which the direction perpendicular to the diameter direction of rotating discs is the axial direction.

First, an example of the configuration of the Siegbahn type molecular pump is now described in which the Siegbahn type molecular pump has a vacuum exhaust mechanism with a return exhaust system where the gas in the Siegbahn type molecular pump upstream region is evacuated from the outer diameter side toward the inner diameter side and then the gas in the Siegbahn type molecular pump downstream region is evacuated from the inner diameter side toward the outer diameter side.

(ii-1) Configuration

Figure 1:
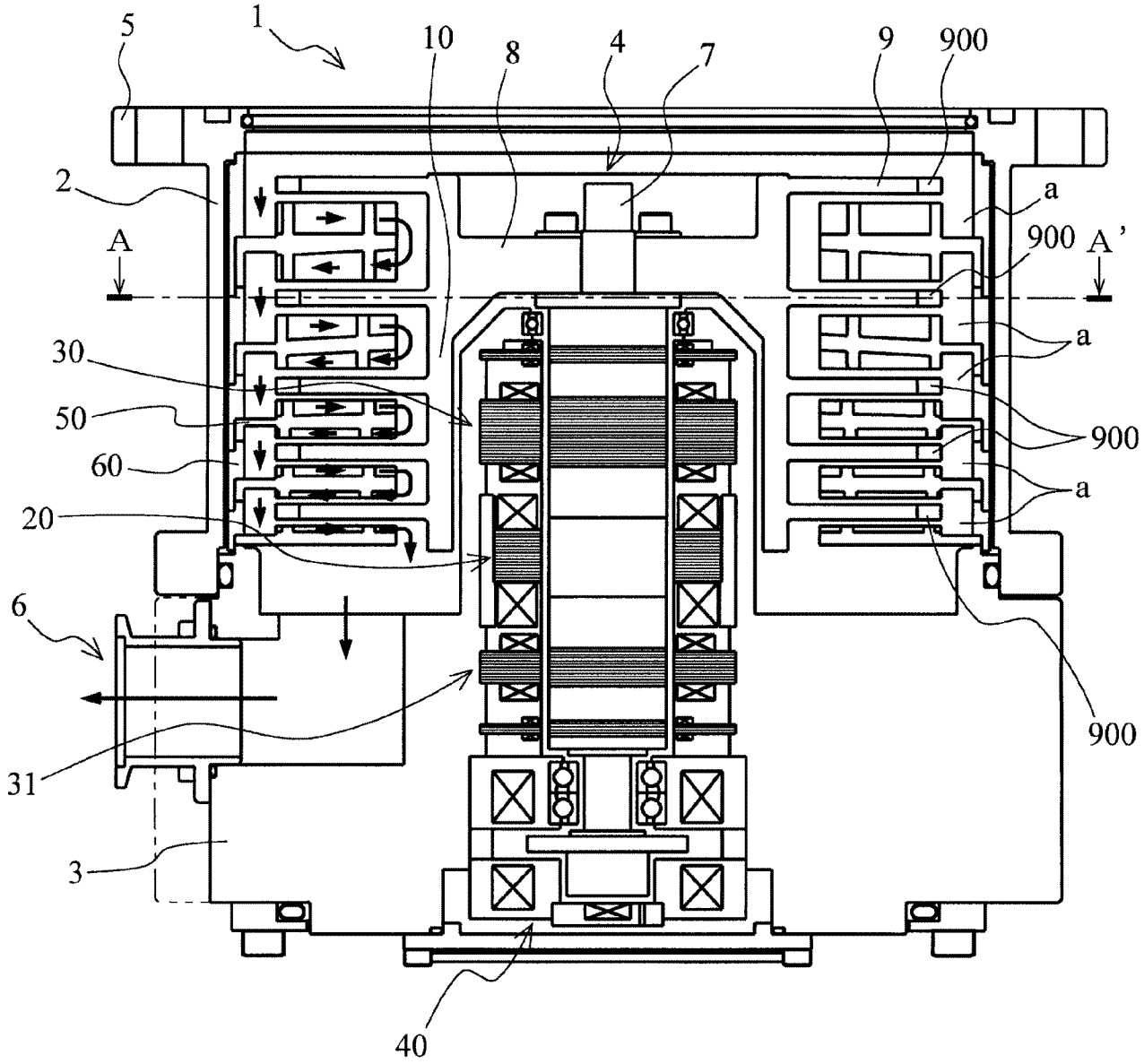
FIG. 1 is a diagram showing an example of a schematic configuration of a Siegbahn type molecular pump according to an embodiment of the present invention.

FIG. 1 is a diagram showing an example of a schematic configuration of a Siegbahn type molecular pump 1 according to a first embodiment of the present invention, showing a cross-sectional diagram of the Siegbahn type molecular pump 1 in the axial direction. Note that the arrows in the diagram show how a gas flows. Note that the arrows showing how a gas flows are shown in a part of the diagram.

A casing 2 constituting a housing of the Siegbahn type molecular pump 1 is roughly in the shape of a cylinder and configures a housing of the Siegbahn type molecular pump 1 along with a base 3 provided below the casing 2 (on the outlet port 6 side). A gas transfer mechanism, a structure that brings out the exhaust function of the Siegbahn type molecular pump 1, is stored in this housing.

This gas transfer mechanism is configured mainly with a rotating portion supported (axially supported) rotatably and a stator portion fixed to the housing.

An inlet port 4 for introducing a gas into the Siegbahn type molecular pump 1 is formed at an end portion of the casing 2. A flange portion 5 protruding toward the outer periphery is formed on an end surface of the casing 2 at the inlet port 4 side.

An outlet port 6 for evacuating the gas from the Siegbahn type molecular pump 1 is formed on the base 3.

The rotating portion (rotor portion) is configured with a shaft 7, which is a rotary shaft, a rotor 8 disposed on the shaft 7, a plurality of rotating discs 9 provided on the rotor 8, a rotating cylinder (rotator cylinder portion) 10, and the like. The rotor portion is configured with the shaft 7 and the rotor 8.

Each of the rotating discs 9 is formed from a disc-shaped member that extends radially in the direction perpendicular to the axis of the shaft 7.

The rotating cylinder 10 is formed from a cylindrical member concentric with the axis of rotation of the rotor 8.

A motor portion 20 for rotating the shaft 7 at high speeds is provided around the middle of the shaft 7 in the axial direction.

Furthermore, radial magnetic bearing devices 30, 31 for supporting (axially supporting) the shaft 7 in a radial direction in a non-contact manner are provided on the inlet port 4 side and the outlet port 6 side of the shaft 7 with respect to the motor portion 20. On the other hand, an axial magnetic bearing device 40 for supporting (axially supporting) the shaft 7 in the axial direction in a non-contact manner is provided at the lower end of the shaft 7.

The stator portion is formed on the inner peripheral side of the housing. This stator portion is configured with, for example, a plurality of stator disc 50 with spiral-shaped grooves that are provided on the inlet port 4 side. The spiral-shaped grooves with ridge portions and root portions are engraved in the stator disc 50.

According to the present embodiment, the spiral-shaped grooves are engraved in the stator disc (the stator disc 50 with spiral-shaped grooves); however, the configuration of the spiral-shaped grooves is not limited thereto. A spiral-shaped groove flow channel may be engraved on a gap-facing surface of at least either each of the rotating discs 9 or each of the stator disc.

Each of the stator disc 50 with spiral-shaped grooves is configured with a disc-shaped member that extends radially in the direction perpendicular to the axis of the shaft 7.

The stator disc 50 with spiral-shaped grooves in each stage is fixed to a cylindrical spacer 60 (stator portion) with a distance therebetween. The arrows shown in FIG. 1 show how the gas flows. In the Siegbahn type molecular pump 1, the rotating discs 9 and the stator disc 50 with spiral-shaped grooves are disposed alternately in a plurality of stages in the axial direction, but any number of rotor parts and stator parts can be provided according to need in order to fulfill the exhaust performance required in the vacuum pump.

The Siegbahn type molecular pump 1 configured as described above executes a vacuum exhaust process in a vacuum chamber (not shown) provided therein.

The Siegbahn type molecular pump 1 according to each embodiment of the present invention has groove portions 900, as shown in FIG. 1.

(ii-2-i) First Embodiment

The Siegbahn type molecular pump portion of the Siegbahn type molecular pump 1 according to the first embodiment of the present invention has a configuration in which, for example, spiral-shaped grooves in the stator portion but not in the rotating portion (rotor portion).

In the first embodiment of the present invention, the groove portions 900 are provided in the outer diameter portions of the rotating discs 9 configuring the rotating portion (rotor portion).

Figure 2:
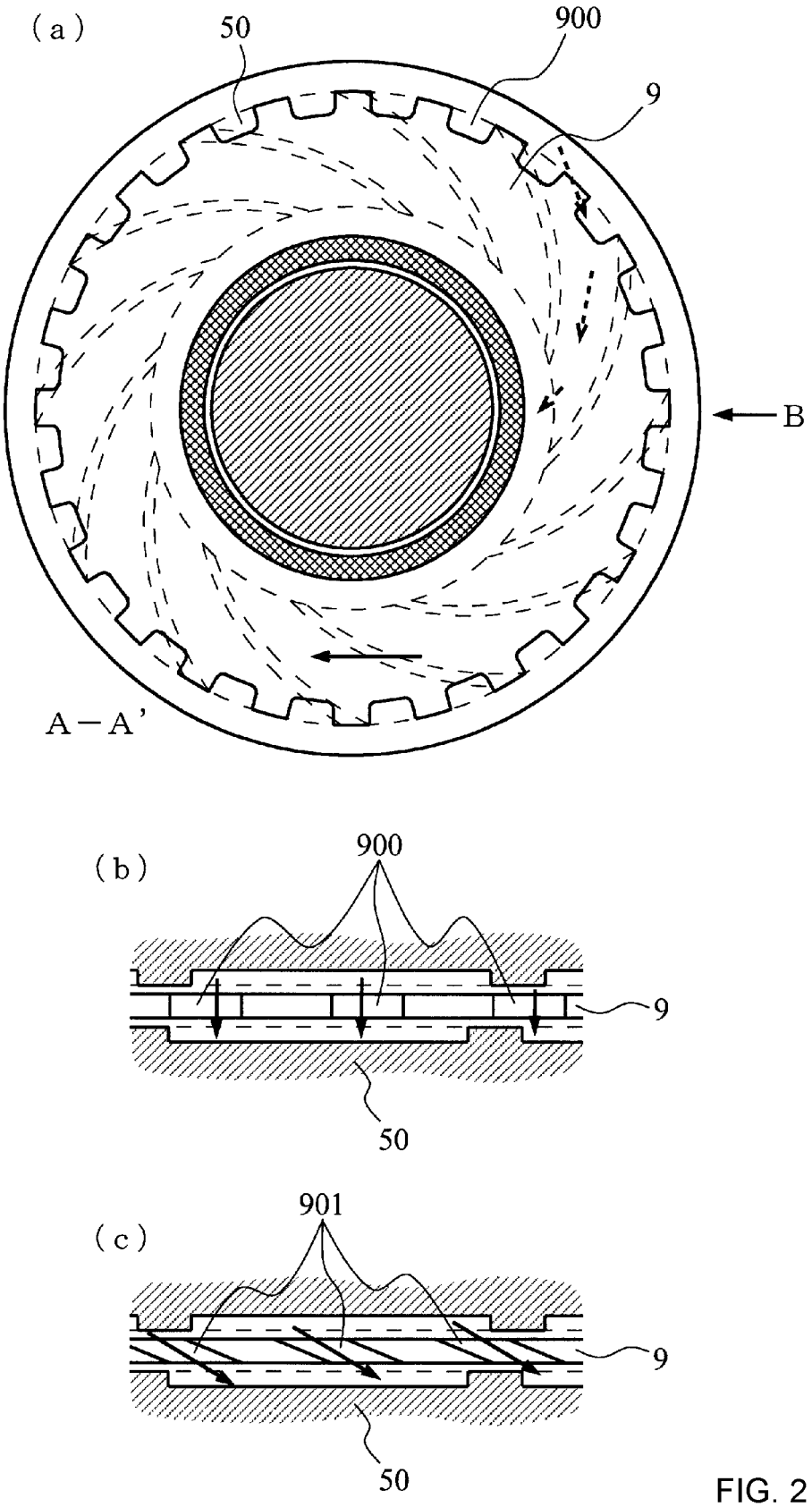
FIG. 2 is a diagram for explaining a rotating disc according to the embodiment of the present invention.

FIG. 2 is a diagram for explaining the rotating discs 9 according to the first embodiment of the present invention. As shown in the diagram, according to the first embodiment of the present invention, the outer diameter of the rotating discs 9 is substantially equal to the outer diameter of the surfaces of the stator disc 50 where the spiral-shaped grooves are engraved.

FIG. 2A is a cross-sectional diagram of one of the rotating discs 9, taken along A-A' direction shown in FIG. 1 in which the rotating disc 9 is viewed from the inlet port 4 side. In this diagram, a part of one of the stator disc 50 with spiral-shaped grooves is shown under the rotating disc 9.

Also in this diagram, the spiral-shaped grooves of this stator disc 50 are shown with broken lines. The solid arrows shown in this diagram represent the direction of rotation of the rotating disc 9, and the broken arrows show how the gas molecules (gas) flow in the flow channel.

FIG. 2B is an arrow view taken along B direction shown in FIG. 2A, showing the stator disc 50 with spiral-shaped grooves, and the rotating disc 9 with the groove portions 900 that is sandwiched between the upstream (the inlet port 4 side) surface of the stator disc 50 with spiral-shaped grooves and the downstream (the outlet port 6 side) surface of the same. The solid arrows in the diagram show how the gas molecules flow.

FIG. 2C is a diagram for explaining groove portions 901 that are configured by tilting the groove portions 900. The groove portions 901 are described hereinafter in detail in a modification of the first embodiment.

Figure 3:
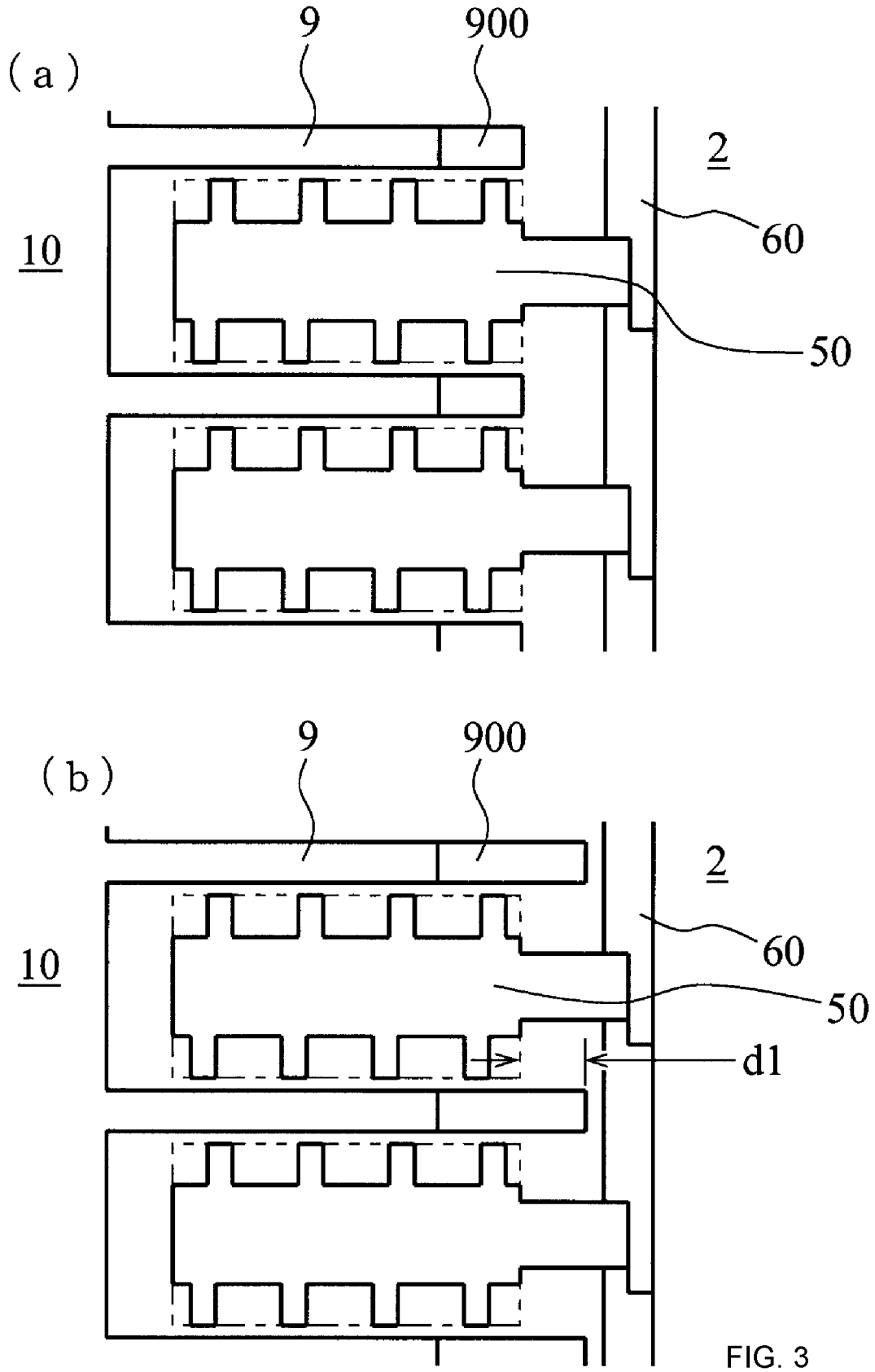
FIG. 3 is an enlarged view for explaining a groove portion according to the embodiment of the present invention.

FIG. 3 is a partial enlarged view of a Siegbahn type exhaust mechanism (Siegbahn type molecular pump portion), explaining the groove portions 900 according to the first embodiment of the present invention.

As shown in FIGS. 2A, 2B and 3A, the groove portions 900 are formed in the outer peripheral portions (outer diameter portions) of the rotating discs 9 according to the first embodiment of the present invention. More precisely, in order to connect the upstream side of the flow channel of the gas transfer mechanism (Siegbahn type molecular pump portion) of the Siegbahn type molecular pump 1 with the downstream side of the same, the groove portions 900 that connect the surface of the Siegbahn type molecular pump upstream region (i.e., the surface on the side of the inlet port) of the rotating discs 9 with the surface of the Siegbahn type molecular pump downstream region (i.e., the surface on the side of the outlet port) of the same are engraved in the outer diameter portions of the rotating discs 9.

According to such a configuration having the rotating discs 9 in which the groove portions 900 are formed, even if the size of the outer returning flow channel a (FIG. 1) configured by the spacer 60 and the rotating discs 9 is reduced, the opening area of the flow channel of the Siegbahn type molecular pump portion can be ensured so that the section thereof between the upstream side and the downstream side does not close.

More specifically, the gas molecules can pass through the space formed by the groove portions 900 as a part of the outer returning flow channel a (i.e., the flow channel added as a returning flow channel).

On the other hand, the exhaust action is induced by the interaction between the parts of the outer peripheral portions of the rotating discs 9 where the groove portions 900 are not formed and the stator disc 50 with spiral-shaped grooves.

In other words, the flow channel area of the returning flow channel between the outlet of the upstream region of the Siegbahn type molecular pump 1 and the outlet of the downstream region of the same can be increased by the cross-sectional area of the groove portions 900, compared to the configuration in which the groove portions 900 are not formed. The cross-sectional area of the outer returning flow channel a can be reduced in accordance with this increase.

In the present embodiment, this configuration can achieve a reduction of the outer diameters of the spacer 60 and the casing 2, reducing the sizes of the parts and hence the costs and the size of the Siegbahn type molecular pump 1.

It is preferred that the width, pitch, aperture ratio and the like of the groove portions 900 be set as appropriate based on the ratio between the cross-sectional area necessary to make the outer returning flow channel a and the parts (surfaces) of the rotating discs 9 without the groove portions 900 that are required to induce the exhaust action.

In addition, the amount of gas molecules flowing backwards against the exhaust action of the Siegbahn type molecular pump 1 increases as the pressure increases. The peripheral width, the radial depth, the pitches, and the aperture ratio of the groove portions 900 disposed at the outlet port 6 side need to be narrower, finer, and smaller than those of the groove portions 900 disposed at the inlet port 4 side.

The first embodiment of the present invention is preferably not configured in such a manner as to deteriorate the drag effect of the gas molecules provided with a momentum by the rotating discs 9, to make the groove portions 900 deeper toward the inside (i.e., radially inward of the rotating discs 9) (make the slits deeper) for the purpose of reducing the possibility that the gas molecules might flow backwards from the downstream portion toward the upstream portion, or to increase the aperture ratio of the groove portions 900 with respect to the periphery of the rotating discs 9.

It is preferred that the width and depth (radial direction) of the groove portions 900 according to the first embodiment of the present invention be determined as appropriate in accordance with the pressure conditions on the sections to be installed with the groove portions 900 and especially the characteristics of the gas to be evacuated. However, for the purpose of ensuring at least the drag effect, it is preferred that the depth of the groove portions 900 be less than 30% or more preferably less than 10% of the radial width of the spiral-shaped grooves engraved in the stator disc 50, as shown in FIG. 3.

Moreover, as shown in FIG. 3B, in the first embodiment of the present invention the groove portions 900 may extend to the sections where the spiral-shaped grooves are not formed.

(ii-2-ii) Modification of First Embodiment

The first embodiment described above can be modified as follows.

FIG. 2C is an arrow view taken along B direction shown in FIG. 2A, wherein the solid arrows show how the gas molecules flow.

As shown in FIG. 2C, in the structure according to the modification of the first embodiment of the present invention, the outer peripheral portion of the rotating disc 9 is provided with a groove portion 901 that is connected with the upstream side and downstream side of the flow channel in the gas transfer mechanism (Siegbahn type molecular pump portion) of the Siegbahn type molecular pump 1 and is inclined toward the outlet port 6 along the direction of rotation of the rotating discs 9 (i.e., at a predetermined angle to the axial direction of the Siegbahn type molecular pump 1). Specifically, the present modification is different from the first embodiment in that the groove portions each have an inclination (i.e., the groove portions are disposed axially obliquely in the outer diameter portions of the rotating discs 9).

In the modification of the first embodiment of the present invention, the groove portions formed in the rotating discs 9 (the groove portions 900) are configured into the groove portions 901 having inclined surfaces, so the gas molecules entering the inclined surfaces can be provided with an advantageous momentum and thereby reflected/spread mainly in the exhaust direction (toward the downstream).

As a result, the Siegbahn type molecular pump 1 can cause the exhaust action more efficiently.

The configurations of the first embodiment and the modification can cause the exhaust action in the conventional outer returning flow channel that is installed as a connecting pipe line in which the exhaust action is not caused, thereby further improving the pump performance of the Siegbahn type molecular pump 1.

(ii-3-1) Second Embodiment

Figure 4:
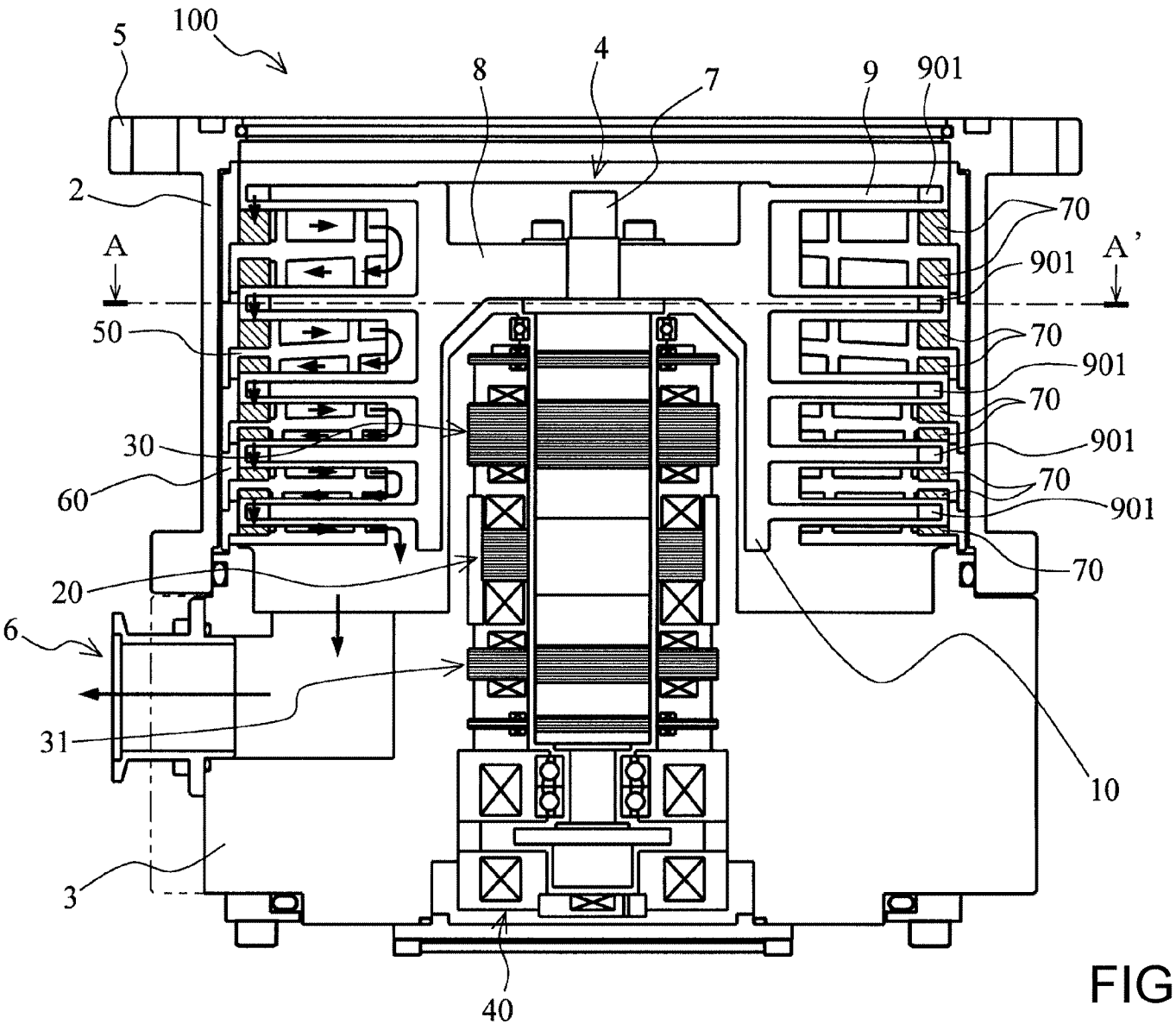
FIG. 4 is a diagram showing an example of a schematic configuration of a Siegbahn type molecular pump according to an embodiment of the present invention.

FIG. 4 is a diagram showing an example of a schematic configuration of a Siegbahn type molecular pump 100 according to a second embodiment of the present invention, the diagram being a cross-sectional diagram taken along the axial direction of the Siegbahn type molecular pump 100.

The configurations same as those shown in FIG. 1 are provided with the same reference numerals; thus, the explanations thereof are omitted accordingly.

As shown in FIG. 4, the Siegbahn type molecular pump 100 according to the second embodiment of the present invention has the groove portions 901 disposed at a predetermined angle to the axial direction of the Siegbahn type molecular pump 100, and oblique plates 70.

Figure 5:
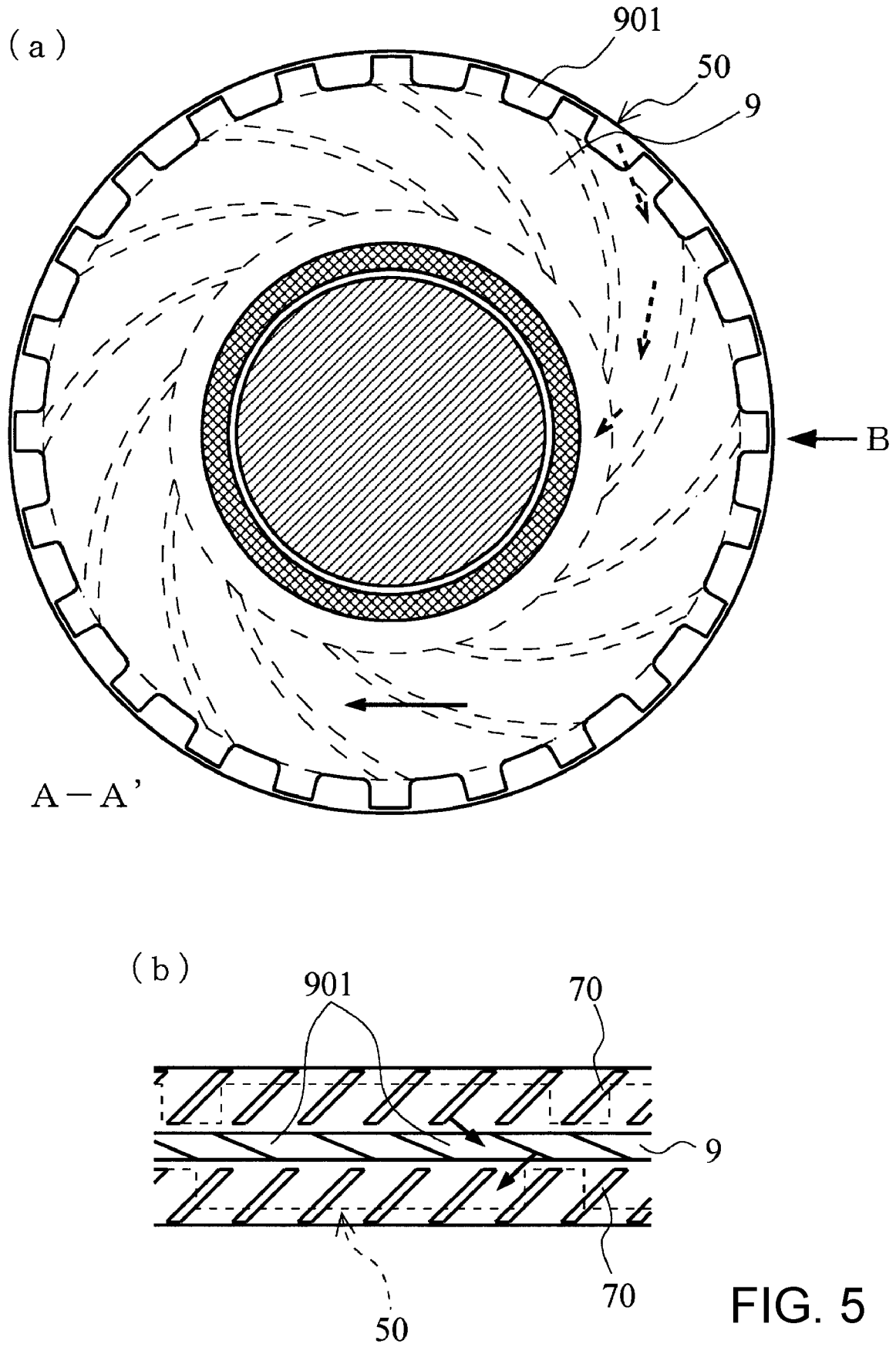
FIG. 5 is a diagram for explaining a rotating disc according to the embodiment of the present invention.
Figure 6:
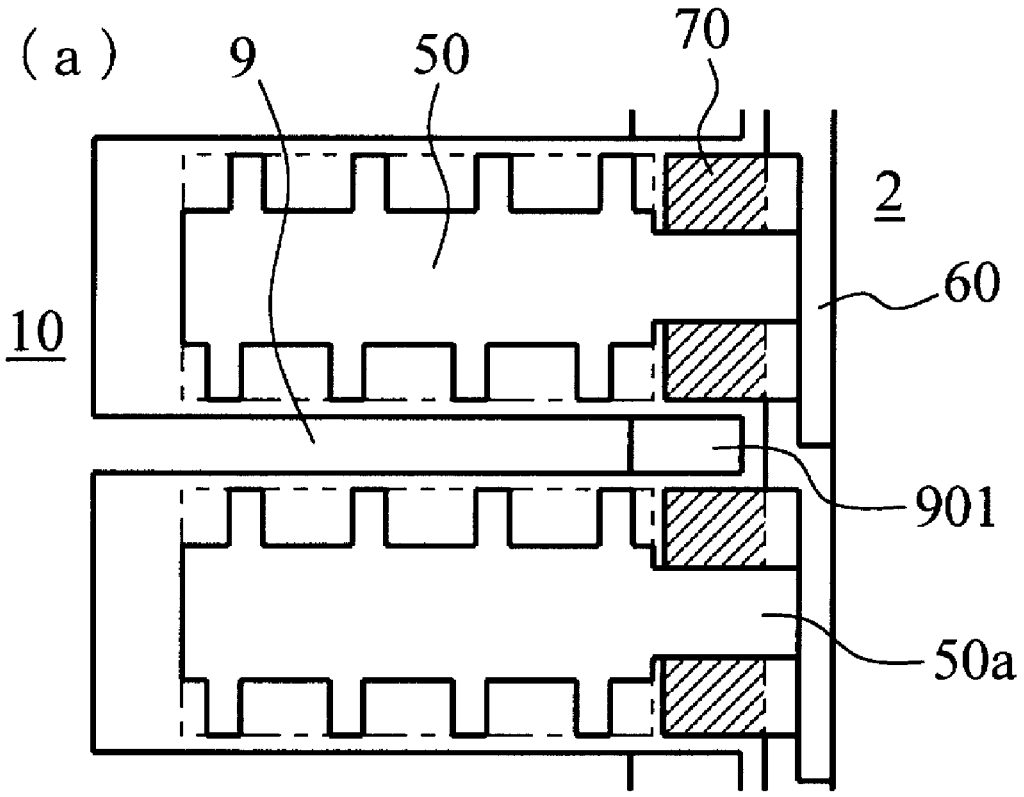
FIG. 6 is an enlarged view for explaining the embodiment of the present invention.
Figure 6:
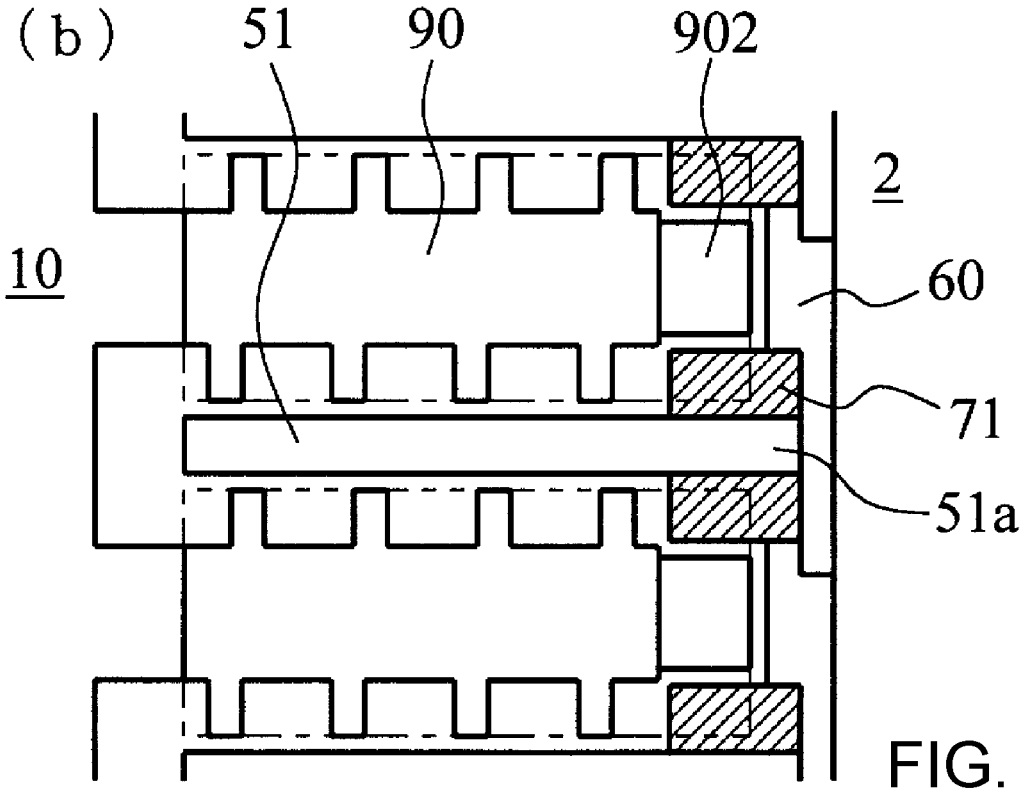
Figure 7:
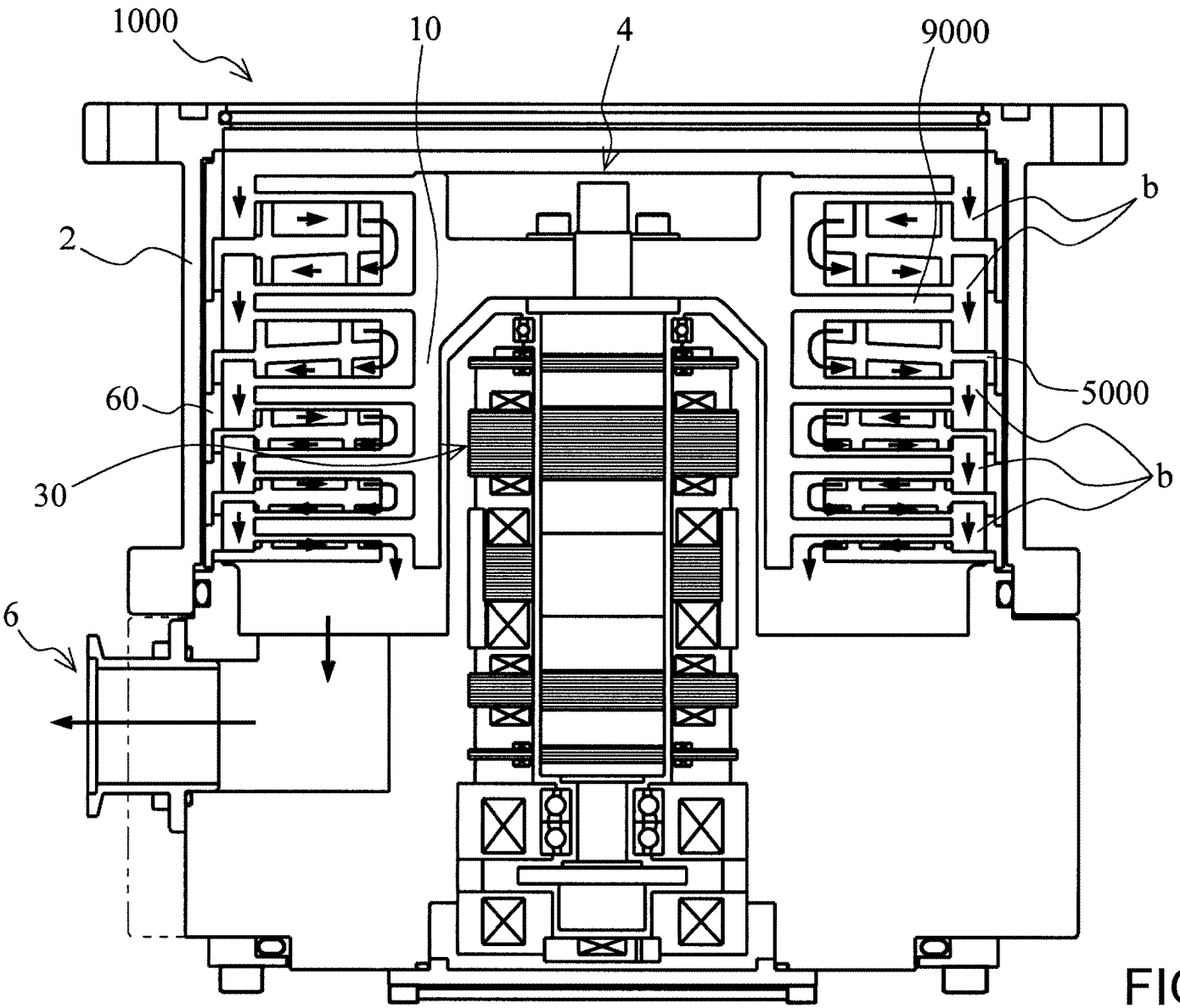
FIG. 7 is a diagram for explaining a prior art, showing an example of a schematic configuration of a conventional Siegbahn type molecular pump.
Figure 8:
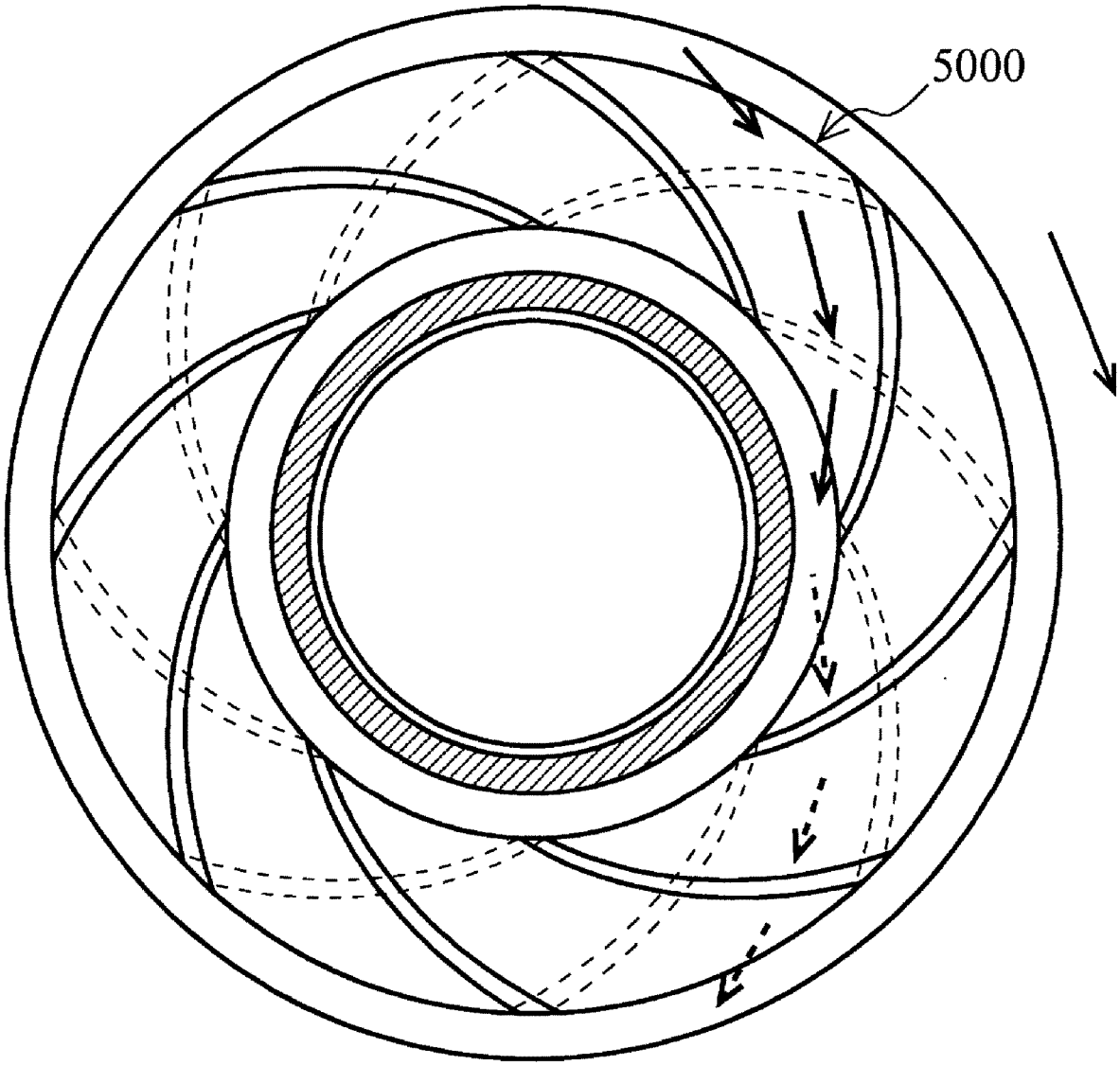
FIG. 8 is a cross-sectional diagram for explaining the prior art, showing a stator disc viewed from an inlet port.

FIG. 5 is a diagram for explaining the rotating discs 9 according to the second embodiment of the present invention.

FIG. 5A is a cross-sectional diagram taken along A-A' direction shown in FIG. 4, showing one of the rotating discs 9 viewed from the inlet port 4 side. This diagram also shows a part of one of the stator disc 50 with spiral-shaped grooves under the rotating disc 9. The broken lines represent the spiral-shaped grooves engraved in the stator disc 50. The solid arrow shown in the diagram represents the direction of rotation of the rotating disc 9, and the broken arrows show how the gas molecules (gas) flow in the flow channel.

FIG. 5B is an arrow view taken along B direction shown in FIG. 5A, wherein the solid arrows show how the gas molecules flow, and the broken lines represent the stator disc 50 with spiral-shaped grooves.

FIG. 6A is an enlarged view for explaining the second embodiment of the present invention. The Siegbahn type molecular pump portion of the Siegbahn type molecular pump 100 according to the second embodiment of the present invention has a configuration in which, for example, the spiral-shaped grooves are formed in the stator portion but not in the rotating portion (rotor portion).

In the Siegbahn type molecular pump 100 according to the second embodiment of the present invention, as shown in FIGS. 5B and 6A, the outer diameter portion of the rotating disc 9 in which no spiral-shaped grooves are formed is provided with the groove portion 901 having a predetermined angle to the axial direction of the Siegbahn type molecular pump 100. In the stator disc 50 provided with spiral-shaped grooves, the oblique plates 70 sitting at a predetermined angle in a direction opposite to the direction of inclination of the foregoing groove portion 901 (to the axial direction of the Siegbahn type molecular pump 100) are disposed at an outer diameter end portion 50*a* of the stator disc 50 where no spiral-shaped grooves are formed.

More specifically, the oblique plates 70 according to the second embodiment of the present invention are thin, plate-shaped members that protrude from the spacer 60 side toward the rotating cylinder 10 side and are fixed to the stator disc 50 with spiral-shaped grooves in such a manner as to be disposed above and below the flow channel formed by the groove portions 901 of the rotating disc 9 (on the inlet port 4 side and the outlet port 6 side), with a gap between the oblique plates 70 and the rotating disc 9 (i.e., with a predetermined distance to the groove portions 901 in the axial direction of the Siegbahn type molecular pump 100).

The oblique plates 70 are disposed between the upstream side (the inlet port 4 side) and the downstream side (the outlet port 6 side) in the second embodiment of the present invention, but may be disposed either on the upstream side or the downstream side.

In other words, in the second embodiment of the present invention, the gas molecules flowing through the gas transfer mechanism (Siegbahn type molecular pump portion) are given a momentum preferential to the exhaust direction by the interaction between the space (gap) inside the groove portions 901 formed in the rotating disc 9 and the oblique plates 70 inclined in the direction axially opposite to the direction of inclination of the groove portions 901, and at the same time pass through the flow channel turning back at the outer diameter side (the outer returning flow channel a).

According to this configuration, in the Siegbahn type molecular pump 100 according to the second embodiment of the present invention, the gas molecules that are given the momentum preferential to the exhaust direction by the groove portions 901 in the gas transfer mechanism of the Siegbahn type molecular pump 100 can be further reflected and spread by the oblique plates 70 in the preferential exhaust direction in the outer returning flow channel a (the position same as that shown in FIG. 1. The flow channel in the axial direction of the Siegbahn type molecular pump 1).

In this manner, the second embodiment of the present invention can bring out the synergetic effect between the groove portions 901 and the oblique plates 70, preventing, more proactively, the momentum from becoming dissipated. In addition, the exhaust action can constantly occur in the outer returning flow channel a (the position same as that shown in FIG. 1).

(ii-3-ii) Modification of Second Embodiment

The spiral-shaped grooves are formed in the stator disc configuring the stator portion in the foregoing second embodiment, but may be formed in the rotating portion (rotor portion).

In the Siegbahn type molecular pump 100 according to a modification of the second embodiment of the present invention, a rotating disc 90 in which spiral-shaped grooves are formed is provided with groove portions 902 that sit at a predetermined angle to the axial direction of the Siegbahn type molecular pump 100, as shown in FIG. 6B. Furthermore, oblique plates 71 sitting at a predetermined angle in a direction opposite to the direction of inclination of the groove portions 902 (to the axial direction of the Siegbahn type molecular pump 100) are disposed at an outer diameter end portion 51*a* of a stator disc 51 where no spiral-shaped grooves are formed.

As with the foregoing second embodiment, the oblique plates 71 are thin, plate-shaped members that are fixed to the stator disc 51 in such a manner as to be disposed above and below the flow channel formed by the groove portions 902 of the rotating disc 90 with spiral-shaped grooves (on the inlet port 4 side and the outlet port 6 side), with a distance to the rotating disc 90 with spiral-shaped grooves (i.e., with a predetermined distance to the groove portions 902 in the axial direction of the Siegbahn type molecular pump 100).

In the modification of the second embodiment of the present invention, as shown in FIG. 6B, the oblique plates 71 are installed between the spacer 60 on the upstream (the inlet port 4) side and the groove portions 902 (the rotating disc 90 with spiral-shaped grooves) and between the groove portions 902 (the rotating disc 90 with spiral-shaped grooves) and the spacer 60 on the downstream (the outlet port 6) side. However, the oblique plates 71 may be disposed either on the upstream side or the downstream side.

According to the modification of the second embodiment of the present invention, the gas molecules are given a momentum preferential to the exhaust direction by the interaction between the space inside the groove portions 902 formed in the rotating disc 90 with spiral-shaped grooves and the oblique plates 71 having an inclination in the direction axially opposite to the direction of the inclination of the groove portions 902, and at the same time pass through the flow channel turning back at the outer diameter side (the outer returning flow channel a). The synergetic effect by this interaction can prevent, more proactively, the momentum from becoming dissipated. In addition, the exhaust action can constantly occur in the outer returning flow channel a.

The configurations of the second embodiment and the modification can cause the exhaust action in the conventional outer returning flow channel that is installed as a connecting pipe line in which the exhaust action is not caused, thereby further improving the pump performance of the Siegbahn type molecular pump 100.

In the Siegbahn type molecular pump (1, 100), the groove portions 900 (901, 902) according to the embodiments and modifications of the present invention can be employed in discs that are arranged in the uppermost-stream returning flow channel that is disposed above these grooves and does not have the pump element of the molecular pump portion configured with the Siegbahn type exhaust mechanism alone or in the lowermost-stream returning flow channel that is disposed below these grooves and does not have the pump element of the Siegbahn type molecular pump portion (the rotating discs 9 or rotating discs 90 with spiral-shaped grooves if the discs are of the rotating portion, and the stator disc 51 or stator disc 50 with spiral-shaped grooves if the discs are of the stator portion). The oblique plates 70 (71) corresponding to the groove portions formed in either one of the discs can also be employed in the uppermost-stream flow channel and the lowermost-stream flow channel.

The inclinations of the groove portions (the predetermined angles) described in the foregoing embodiments and modifications of the present invention are preferably set downward at 5 to 85 degrees (depression angle/inclination) with respect to the direction that is perpendicular to the axis of the Siegbahn type molecular pump (1, 100) as the horizontal reference.

Note that the foregoing embodiments may be combined in various ways.

The foregoing embodiments of the present invention are not limited to a Siegbahn type molecular pump. The embodiments of the present invention can be applied to a compound turbomolecular pump with a Siegbahn type molecular pump portion and a turbomolecular pump portion, a compound turbomolecular pump with a Siegbahn type molecular pump portion and a thread groove pump portion, or a compound turbomolecular pump (vacuum pump) with a Siegbahn type molecular pump portion, a turbomolecular pump portion, and a thread groove pump portion.

Although not shown, a compound type vacuum pump with a turbomolecular pump portion is further provided with a rotating portion configured with a rotary shaft and a rotator fixed to the rotary shaft, wherein the rotator has multiple stages of rotor blades (moving blades) arranged radially. The compound type vacuum pump also has a stator portion that is provided with a multiple stages of stator blades (stationary blades) arranged to alternate with the rotor blades.

Also although not shown, a compound type vacuum pump with a thread groove pump portion is further provided with a thread groove spacer that has a spiral-shaped groove on its surface opposite to a rotating cylinder and is opposite the outer peripheral surface of the rotating cylinder with a predetermined clearance therebetween, and a gas transfer mechanism in which when the rotating cylinder rotates at high speed, the gas is sent toward the side of the outlet port while being guided by the thread groove (spiral-shaped groove) as the rotating cylinder rotates. The smaller the clearance the better, in order to reduce the force of the gas flowing back toward the inlet port.

Also although not shown, a compound turbomolecular pump with a turbomolecular pump portion and a thread groove pump portion is further provided with the foregoing turbomolecular pump portion, the foregoing thread groove pump portion, and a gas transfer mechanism in which the gas is compressed by the turbomolecular pump portion (first gas transfer mechanism) and thereafter further compressed by the thread groove pump portion (second gas transfer mechanism).

With this configuration, the Siegbahn type molecular pump (1, 100) according to each of the embodiments of the present invention can achieve the following effects.

(1) Loss of the gas molecules turn at the flow channel (the outer returning flow channel) formed on the outer diameter side can be minimized Therefore, an efficient Siegbahn type molecular pump can be constructed.

(2) Synergetic effect can be exerted on the exhaust action by the groove portions (900, 901, 902) and the oblique plates (70, 71). Therefore, the momentum of the gas molecules is proactively prevented from being dissipated in the outer returning flow channel, keeping the continuity of the exhaust action in the outer returning flow channel.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum exhaust mechanism, comprising:

a housing in which an inlet port and an outlet port are formed;

a rotating shaft contained in the housing and supported rotatably;

a rotating body part that has a rotating disc-shaped portion disposed on the rotating shaft or an outer peripheral surface of a cylindrical body disposed around the rotating shaft;

an upstream side stator disc-shaped portion that is disposed concentrically with the rotating disc-shaped portion and is opposite to the rotating disc-shaped portion in an axial direction in an upstream side with a space therebetween;

a downstream side stator disc-shaped portion that is disposed concentrically with the rotating disc-shaped portion and is opposite to the rotating disc-shaped portion in an axial direction in a downstream side with a space therebetween; and a spacer portion that is formed separately from the upstream side stator disc-shaped portion or the downstream side stator disc-shaped portion, or integrally with the upstream side stator disc-shaped portion or the downstream side stator disc-shaped portion in order to fix the upstream side stator disc-shaped portion or the downstream side stator disc-shaped portion, the vacuum exhaust mechanism transferring a gas suctioned from a side of the inlet port to a side of the outlet port by an interaction between the rotating disc-shaped portion and the upstream side stator disc-shaped portion or the downstream side stator disc-shaped portion, wherein the upstream side stator disc-shaped portion has an upstream side spiral-shaped groove with a ridge portion and a root portion on at least a part of an opposed surface with the rotating disc-shaped portion in the axial direction, the downstream side stator disc-shaped portion has a downstream side spiral-shaped groove with a ridge portion and a root portion on at least a part of an opposed surface with the rotating disc-shaped portion in the axial direction, the rotating disc-shaped portion has, in at least a part of an outer peripheral portion thereof, a groove portion for connecting a surface of the rotating disc-shaped portion on the side of the inlet port with a surface of the same on the side of the outlet port, and a phase of an outer diameter position of the ridge portion of the upstream side spiral-shaped groove is substantially equal to a phase of an outer diameter position of the ridge portion of the downstream side spiral-shaped groove.

2. The vacuum exhaust mechanism according to claim 1, wherein the groove portion is disposed to incline in an exhaust direction of the vacuum exhaust mechanism at an inclination angle to a central axis of the rotating disc-shaped portion.

3. The vacuum exhaust mechanism according to claim 2, wherein an oblique plate which opposes to at least either an opening end of the groove portion on the side of the inlet port or an opening end of the same on the side of the outlet port is provided to at least either the stator disc-shaped portion or the spacer portion, and the oblique plate is disposed to incline in a direction opposite to the inclination angle of the groove portion at an inclination angle to the central axis of the rotating disc-shaped portion.

4. A compound type vacuum pump, comprising in a compounded form:

a Siegbahn type exhaust mechanism portion having the vacuum exhaust mechanism of claim 2; and a thread groove type molecular pump mechanism portion, which is a vacuum exhaust mechanism that has a thread groove in at least a part of an opposed surface, at which a stator portion disposed inside the housing and an outer peripheral surface of a cylindrical body disposed around the rotating shaft are opposite to each other, and transfers the gas suctioned from the side of the inlet port to the side of the outlet port.

5. A compound type vacuum pump, comprising in a compounded form:

a Siegbahn type exhaust mechanism portion having the vacuum exhaust mechanism of claim 2;

rotor blades that extend radially from the rotating shaft or an outer peripheral surface of a cylindrical body disposed around the rotating shaft; and a turbomolecular pump mechanism portion, which is a vacuum exhaust mechanism that has stator blades disposed with a predetermined distance to the rotor blades and transfers the gas suctioned from the side of the inlet port to the side of the outlet port, by an interaction between the rotor blades and the stator blades.

6. A compound type vacuum pump, comprising in a compounded form:

a Siegbahn type exhaust mechanism portion having the vacuum exhaust mechanism of claim 2;

a thread groove type molecular pump mechanism portion that has a thread groove in at least a part of an opposed surface at which a stator portion disposed inside the housing and an outer peripheral surface of a cylindrical body disposed around the rotating shaft are opposite to each other and transfers the gas suctioned from the side of the inlet port to the side of the outlet port; and a turbomolecular pump mechanism portion, which is a vacuum exhaust mechanism that has rotor blades that extend radially from the rotating shaft or an outer peripheral surface of a cylindrical body disposed around the rotating shaft and stator blades disposed with a predetermined distance to the rotor blades, and that transfers the gas suctioned from the side of the inlet port to the side of the outlet port, by an interaction between the rotor blades and the stator blades.

7. A compound type vacuum pump, comprising in a compounded form:

a Siegbahn type exhaust mechanism portion having the vacuum exhaust mechanism of claim 1; and a thread groove type molecular pump mechanism portion, which is a vacuum exhaust mechanism that has a thread groove in at least a part of an opposed surface, at which a stator portion disposed inside the housing and an outer peripheral surface of a cylindrical body disposed around the rotating shaft are opposite to each other, and transfers the gas suctioned from the side of the inlet port to the side of the outlet port.

8. A compound type vacuum pump, comprising in a compounded form:

a Siegbahn type exhaust mechanism portion having the vacuum exhaust mechanism of claim 1;

rotor blades that extend radially from the rotating shaft or an outer peripheral surface of a cylindrical body disposed around the rotating shaft; and a turbomolecular pump mechanism portion, which is a vacuum exhaust mechanism that has stator blades disposed with a predetermined distance to the rotor blades and transfers the gas suctioned from the side of the inlet port to the side of the outlet port, by an interaction between the rotor blades and the stator blades.

9. A compound type vacuum pump, comprising in a compounded form:

a Siegbahn type exhaust mechanism portion having the vacuum exhaust mechanism of claim 1;

a thread groove type molecular pump mechanism portion that has a thread groove in at least a part of an opposed surface at which a stator portion disposed inside the housing and an outer peripheral surface of a first cylindrical body disposed around the rotating shaft are opposite to each other and transfers the gas suctioned from the side of the inlet port to the side of the outlet port; and a turbomolecular pump mechanism portion, which is a vacuum exhaust mechanism that has rotor blades that extend radially from the rotating shaft or an outer peripheral surface of a second cylindrical body disposed around the rotating shaft and stator blades disposed with a predetermined distance to the rotor blades, and that transfers the gas suctioned from the side of the inlet port to the side of the outlet port, by an interaction between the rotor blades and the stator blades.

10. A rotating body part, which is used in a vacuum pump having an inlet port and an outlet port and which has a rotating disc-shaped portion, wherein at least a part of an opposed surface of an upstream side stator disc-shaped portion that is opposite to the rotating disc-shaped portion in an axial direction in an upstream side with a space therebetween, has an upstream side spiral-shaped groove with a ridge portion and a root portion in the axial direction, at least a part of an opposed surface of a downstream side stator disc-shaped portion that is opposite to the rotating disc-shaped portion in an axial direction in a downstream side with a space therebetween, has a downstream side spiral-shaped groove with a ridge portion and a root portion in the axial direction, the rotating disc-shaped portion has, in at least a part of an outer peripheral portion thereof, a groove portion for connecting a surface of the rotating disc-shaped portion on the side of the inlet port with a surface of the same on the side of the outlet port, and a phase of an outer diameter position of the ridge portion of the upstream side spiral-shaped groove is substantially equal to a phase of an outer diameter position of the ridge portion of the downstream side spiral-shaped groove.

* * * * *